US005464569A

United States Patent [19]

McConaghy, Jr.

[11] Patent Number: 5,464,569

[45] Date of Patent: Nov. 7, 1995

[54] PROCESS FOR THE PREPARATION OF OXIDATION INHIBITED FLUID COMPOSITIONS

[75] Inventor: John S. McConaghy, Jr., St. Louis, Mo.

[73] Assignee: Monsanto Company, St. Louis, Mo.

[21] Appl. No.: 575,516

[22] Filed: Aug. 30, 1990

[51] Int. Cl.[6] ..... B01J 13/00; C09K 5/00; C09K 15/32; C10M 129/34

[52] U.S. Cl. ..... 252/308; 252/41; 252/76; 252/400.62

[58] Field of Search ..... 252/188.28, 308, 252/309, 400.62, 41, 74, 77

[56] References Cited

U.S. PATENT DOCUMENTS

| | | | |
|---|---|---|---|
| 2,671,758 | 3/1954 | Vinograd et al. | 252/309 X |
| 2,722,516 | 11/1955 | Merker | 252/41 X |
| 3,245,907 | 4/1966 | Stark et al. | 252/46.4 |
| 3,290,247 | 12/1966 | Wilson et al. | 252/42.7 |
| 3,405,072 | 10/1968 | Kinnavy | 252/400.62 |
| 3,492,229 | 1/1970 | Weiss | 252/25 |

OTHER PUBLICATIONS

Ravner et al, *ASLE Trans.*, 18, 1–4 (1975).
Ravner et al, *Asle Trans.*, 15, 45–53 (1972).
Ravner et al, *J. Chem. Eng. Data*, 8, 591–596 (1963).

*Primary Examiner*—Richard D. Lovering
*Attorney, Agent, or Firm*—W. Brooks

[57] ABSTRACT

Oxidation inhibited fluid compositions are prepared by mixing an aromatic ether represented by the formula $$R^1—O\text{-}[R^2—O]_n R^3$$

wherein $R^1$, $R^2$, $R^3$ independently are phenyl, biphenyl, and terphenyl and n is an integer of from zero (0) to 5, and an alkali metal precursor compound convertible under alkali metal precursor compound conversion conditions into an alkali metal salt of oxalic acid, followed by heating the aromatic ether/alkali metal precursor compound mixture at an elevated temperature in the presence of molecular oxygen or a molecular oxygen-containing gas and for a time effective to convert the alkali metal precursor compound into the corresponding alkali metal salt of oxalic acid and form a colloidal dispersion of the aromatic ether and an oxidation inhibiting amount of the alkali metal salt of oxalic acid. The colloidal dispersion is separated from noncolloidally dispersed solid material to thereby recover the oxidation inhibited fluid composition. The fluid compositions are characterized by being transparent when subjected to visual inspection with white light shining through the fluid compositions at a 180° angle to the line of sight.

8 Claims, No Drawings

PROCESS FOR THE PREPARATION OF OXIDATION INHIBITED FLUID COMPOSITIONS

BACKGROUND OF THE INVENTION

1. Field of the Invention

This invention relates to a process for the preparation of oxidation inhibited fluid compositions. More particularly, this invention relates to a process for the preparation of oxidation inhibited fluid compositions comprising a colloidal dispersion of an aromatic ether represented by the formula $$R^1—O\text{-}\!\!\left[R^2—O\right]_n\!\!\text{-}R^3$$

wherein $R^1$, $R^2$, and $R^3$ independently are phenyl biphenyl, and terphenyl and n is an integer of from zero (0) to 5, and an oxidation inhibiting amount of an alkali metal salt of oxalic acid.

The fluid compositions prepared in accordance with the process of this invention are useful in a number of applications requiring fluids resistant to oxidative and thermal degradation under use conditions of high stress (such as elevated temperatures of 316° C. (600° F.) and higher. For example, the fluid compositions prepared in accordance with the process of this invention are useful as atomic reactor coolants, diffusion pump fluids, damping fluids, force transmission fluids (hydraulic fluids), heat transfer fluids, and synthetic lubricants, particularly as jet engine lubricants.

2. Description of the Prior Art

Aromatic ethers, particularly polyphenyl ethers (wherein each of $R^1$, $R^2$, and $R^3$ is phenyl), and their use as functional fluid compositions are well known in the art. They are oxidatively stable to about 275° C. (527° F.) and resist pyrolysis to about 445° C. (833° F.). However, at temperatures above their stability limits, the aromatic ethers tend to develop sludge and thicken to a degree which adversely affects their high temperature performance. Therefore, a variety of additives have been proposed and disclosed in the prior art to stabilize the aromatic ethers against oxidative degradation and thereby extend their operation range.

The susceptibility of the aromatic ethers to some degree of oxidative stabilization by a variety of metals (or their oxides and carboxylates) was reported for polyphenyl ethers by Ravner et al, *J. Chem. Eng. Data,* 8, 591–596 (1963).

U.S. Pat. No. 3,245,907 discloses the stabilization of polyphenyl ethers against oxidative degradation by the incorporation therein of an organotin compound represented by the formula $$R_m—Sn—X_{4-m}$$

and $$R_3—Sn—Sn—R_3$$

wherein R is an alkyl, aryl, aralkyl, aryloxyaryl, biaryl, thienyl, and pyridyl group; X is R or a halogen, and m is an integer (whole number) of from 1 to 4.

In U.S. Pat. No. 3,290,247, polyphenyl ether compositions having improved antioxidant properties are disclosed and claimed. The oxidative stabilization of the polyphenyl ethers is achieved by incorporating therein organotin compounds represented by the formula (I) $R_nSn(XR')_m$ wherein n is an integer of from 2 to 3, m is an integer of from 1 to 2, and the sum of m+n is 4; R is an alkyl group (referred to in the reference as a radical) of from 1 to 12 carbon atoms, benzenoid hydrocarbon groups which are free of olefinic and acetylenic unsaturation and contains from 6 to 12 carbon atoms, and aryloxyaryl groups of from 12 to 24 carbon atoms, and such groups having halogen substituted at the benzenoid nucleus; R' is R, paraffinic and haloparaffinic acyl groups of from 2 to 12 carbon atoms, the group

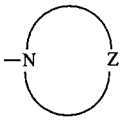

wherein Z is a necessary member to complete a saturated heterocyclic group of from 6 to 10 members, the groups $—SnR_3$ and —arylene—O—$SnR_3$; and X is a chalcogen element having an atomic weight of less than 33, and those represented by the formula

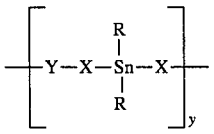

wherein Y is an arylene group of from 6 to 12 carbon atoms, an arylenealkylenearylene group and alkylenearylenealkylene group having from 1 to 4 carbon atoms in the alkylene group and from 6 to 12 carbon atoms in the arylene radical, R and X are as previously defined, and y is a number of from 10 to 1000 (to denote the degree of polymerization).

U.S. Pat. No. 3,492,229 discloses, inter alia, aromatic ether compositions which exhibit improved oxidation resistance. Such compositions are provided by incorporation of organic salts of alkali metals, antimony, bismuth, and lanthanum into the aromatic ether basestock. Such compositions reportedly are useful as jet engine lubricants, heat transfer fluids and hydraulic fluids.

Although these prior art processes generally are effective to provide aromatic ether compositions which generally exhibit increased oxidation stability over aromatic ethers themselves, such aromatic ether compositions, in general, are limited in their application usefulness as functional fluids and engine lubricants under high stress conditions extant in present-day high stress engines—jet engines, for example—as well as engines currently under development for the next generation of jet engines. For example, as the speed and altitude of operation of jet engine-containing vehicles increases, lubrication problems also have increased because of increased operating temperatures and higher bearing pressures resulting from the increased thrust needed to obtain and maintain high speeds and altitudes. And as the service conditions encountered become increasingly severe, the useful life of the functional fluid is shortened, primarily due to their deficiency in oxidative stability above about 275° C. (550° F.). In general, as operating requirements of a jet engine are increased, engine temperatures increase and oil temperatures in the range of 316° C. (600° F.) and higher are encountered. Accordingly, research efforts are continually being made to define new or improved fluid compositions, and processes of making new and old fluid compositions, particularly aromatic ether compositions, and most particularly polyphenyl ether compositions, which exhibit increased oxidative stability and concomitantly are suitable for use as functional fluids under use conditions of high stress. The discovery of the process of the instant invention, therefore, is believed to be a decided advance in the functional fluid art.

SUMMARY OF THE INVENTION

This invention is directed to a process for the preparation of oxidation inhibited fluid compositions having increased oxidative stability under use conditions of high stress (such as elevated temperatures of 316° C. (600° F.) and higher). Accordingly, the primary object of this invention is to provide a process for the preparation of oxidation inhibited fluid compositions having increased resistance to oxidative degradation under use conditions of high stress.

This and other objects, aspects, and advantages of the instant invention will become apparent to those skilled in the art from the accompanying description and claims.

The above object, as well as other related objects, are achieved by a process for the preparation of oxidation inhibited fluid compositions, which process comprises:

(a) mixing an aromatic ether represented by the formula $$R^1—O\text{-}[R^2—O]_n R^3$$

wherein $R^1$, $R^2$, and $R^3$ independently are phenyl, biphenyl, and terphenyl and n is an integer from zero (0) to 5, and an alkali metal precursor compound convertible under alkali metal precursor compound conversion conditions into an alkali metal salt of oxalic acid, (b) heating the aromatic ether/alkali metal precursor compound mixture from Step (a) at an elevated temperature in the presence of molecular oxygen or a molecular oxygen-containing gas and for a time effective to convert the alkali metal precursor compound into an alkali metal salt of oxalic acid and form a colloidal dispersion of the aromatic ether and an oxidation inhibiting amount of the alkali metal salt of oxalic acid, and (c) separating any noncolloidally dispersed solid material from the colloidal dispersion to thereby recover the oxidation inhibited fluid composition, the fluid composition being characterized by being transparent when subjected to visual inspection with white light shining through the fluid composition at a 180° angle to the line of sight.

DESCRIPTION OF THE PREFERRED EMBODIMENTS

In accordance with this invention a process is provided for the preparation of novel oxidation inhibited fluid compositions which are useful as functional fluids under conditions of high stress. These oxidation inhibited fluid compositions are prepared by a process comprising:

(a) mixing an aromatic ether represented by the formula $$R^1—O\text{-}[R^2—O]_n R^3$$

wherein $R^1$, $R^2$, and $R^3$ independently are phenyl, biphenyl, and terphenyl and n is an integer from zero (0) to 5, and an alkali metal precursor compound convertible under alkali metal precursor compound conversion conditions into an alkali metal salt of oxalic acid, (b) heating the aromatic ether/alkali metal precursor compound mixture from Step (a) at an elevated temperature in the presence of molecular oxygen or a molecular oxygen-containing gas and for a time effective to convert the alkali metal precursor compound into an alkali metal salt of oxalic acid and form a colloidal dispersion of the aromatic ether and an oxidation inhibiting amount of the alkali metal salt of oxalic acid, and (c) separating any noncolloidally dispersed solid material from the colloidal dispersion to thereby recover the oxidation inhibited fluid composition, the fluid composition being characterized by being transparent when subjected to visual inspection with white light shining through the fluid composition at a 180° angle to the line of sight.

For purposes of this invention, the term "colloidal dispersion" means a system in which particles of colloidal size (roughly between 1 nanometer (nm) and 1 micron (μm) of one state 'solid phase material (alkali metal salt of oxalic acid)] are dispersed in a continuous phase of a different state. [liquid phase material (aromatic ether)].

The aromatic ethers suitable for use in the instant invention are those represented by the formula $$R^1—O\text{-}[R^2—O]_n R^3$$

wherein $R^1$, $R^2$, and $R^3$ independently are phenyl, biphenyl, and terphenyl and n is an integer of from zero (0) to 5. Among the aromatic ethers, the polyphenyl ethers are generally preferred in that they are readily available and exhibit desirable properties for a wide variety of applications. And among the polyphenyl ethers, those having all their ether linkages in the meta position are in general most preferred since the all-meta linked ethers are the best suited for many applications because of their wide liquid range and high degree of thermal stability. However, mixtures of the polyphenyl ethers, that is, either isomeric mixtures or mixtures of homologous ethers, are also suitable, particularly to obtain certain properties, for example, lower solidification points.

Among the aromatic ethers, nonlimiting examples of suitable polyphenyl ethers are diphenyl ether (also known as diphenyl oxide), the diphenoxybenzenes, for example, m-diphenoxybenzene, the bis(phenoxyphenyl) ethers, for example, bis(m-phenoxyphenyl) ether, the bis(phenoxyphenoxy)benzenes, for example, m-bis(m-phenoxyphenoxy-)benzene, m-bis(p-phenoxyphenoxy)benzene, o-bis(o-phenoxyphenoxy)benzene, the bis(phenoxyphenoxyphenyl) ethers, for example bis[m-(m-phenoxyphenoxy)phenyl] ether, bis[p-(p-phenoxyphenoxy)phenyl] ether, [m-(m-phenoxyphenoxy)phenyl] [o-(o-phenoxyphenoxy)phenyl] ether, and the bis(phenoxyphenoxyphenoxy)benzenes, for example, m-bis[ m-(m-phenoxyphenoxy)phenoxy]benzene, p-bis[p-(m-phenoxyphenoxy)phenoxy] benzene, m-bis[m-(p-phenoxyphenoxy)phenoxy] benzene.

It also is contemplated that mixtures of the polyphenyl ethers can be employed in the instant invention. For example, mixtures of polyphenyl ethers in which the non-terminal phenyl (phenylene) rings [that is wherein $R^2$, which is enclosed in the brackets in the above structural formula representation of suitable aromatic ethers, is phenyl (phenylene)] are linked through oxygen atoms in the meta and para positions, are particularly suitable for use in the instant invention in that such mixtures possess lower solidification points and thus provide fluid compositions having wider liquid ranges.

Of these mixtures, that is, those having only meta and para linkages, a preferred polyphenyl ether mixture for use in the instant invention is the mixture of five-ring polyphenyl ethers where the nonterminal phenylene rings are linked through oxygen atoms in the meta and para positions and composed, by weight, of about 64–65% m-bis(m-phenoxyphenoxy)benzene, 30–32% m-[ (m-Phenoxyphenoxy)(p-phenoxyphenoxy)]benzene, and 3–6% m-bis(p-phenoxyphenoxy)benzene, with the proviso that the sum of the components must equal 100%, with a mixture composed, by weight, of about 64% m-bis(m-phenoxyphenoxy)benzene, 32% m-[(m-phenoxyphenoxy)(pphenoxyphenoxy)] benzene, and 4% m-bis(p-phenoxyphenoxy)benzene being most preferred. Such a mixture solidifies at about 4° C. (40° F.) whereas the three components solidify individually at temperatures above normal room temperatures.

In addition to the polyphenyl ethers (wherein $R^1$, $R^2$, and $R^3$ are phenyl), suitable aromatic ethers include those wherein at least one of $R^1$, $R^2$, and $R^3$ is biphenyl or terphenyl. Nonlimiting examples of such aromatic ethers are the phenoxybiphenyls, for example, o-phenoxybiphenyl, m-phenoxybiphenyl, p-phenoxybiphenyl, the bis(biphenylyl) ethers, for example, bis(o-biphenylyl) ether, bis(p-biphenylyl) ether, (o-biphenylyl)(p-biphenylyl) ether, the diphenoxybiphenyls, for example, those in which the phenoxy groups are attached as substituents on different aromatic rings (of the biphenyl moiety), as in 4,4'-diphenoxybiphenyl, or on the same aromatic ring, as in 3,4-diphenoxybiphenyl, the phenoxyterphenyls, for example, 4-phenoxy-m-terphenyl, and the diphenoxy-terphenyls, including, for example, in a manner similar to that noted for the diphenoxybiphenyls, those in which the phenoxy groups are attached as substituents on different aromatic rings (of the terphenyl moiety), as in 4,4'-diphenoxy-m-terphenyl, or on the same aromatic ring, as in 3,4-diphenoxy-m-terphenyl.

In a manner similar to that previously discussed for the polyphenyl ethers, it also is contemplated that mixtures of the aromatic ethers, in general, can be employed in the instant invention. For example, mixtures of o-phenoxybiphenyl and p-phenoxybiphenyl and o-bis(biphenylyl) ether and p-bis(biphenylyl) ether are suitable for use in the instant invention. Such mixtures, in general, possess lower solidification points and thereby provide fluid compositions having wider liquid ranges.

The aromatic ethers suitable for use in the instant invention can be obtained by the Ullmann ether synthesis which broadly relates to ether-forming reaction of, for example, alkali metal arenoxides (or arenates) such as sodium and potassium phenoxides (or phenates) with aromatic halides, for example, bromobenzene and 4-iodo-4'-bromo-m-terphenyl in the presence of a copper catalyst such as metallic copper, copper hydroxides, or copper salts. Detailed descriptions for the preparation of the polyphenyl ethers are disclosed in U.S. Pat. No. 3,451,061 and Sax et al, "Preparation and Infrared Absorption Spectra of Some Phenyl Ethers," *J. Org. Chem,* 25, 1590–1595 (1960). Detailed descriptions for the preparation of the phenoxyterphenyls (including the multi phenoxy-substituted terphenyls) are disclosed in U.S. Pat. No. 4,143,077. Other aromatic ethers, such as, for example, the phenoxybiphenyls, can be prepared as byproducts in the caustic hydrolysis of chlorobenzene in accordance with the detailed description disclosed in U.S. Pat. No. 4,092,364.

Compounds useful as source materials to provide the alkali metal—that is, the lithium, sodium, potassium, rubidium, and cesium—salts of oxalic acid component of the fluid compositions prepared in accordance with the process of the instant invention are not narrowly critical. All that is necessary is that such compounds provide the desired colloidal dispersion comprising an oxidation inhibiting amount of the alkali metal salt of oxalic acid in the aromatic ether. Suitable source material compounds are compounds convertible at elevated temperatures in the presence of molecular oxygen or a molecular oxygen-containing gas—that is, under colloidal dispersion forming conditions—into the corresponding alkali metal oxalates. As such, compounds which are suitable as source materials to provide the alkali metal oxalates may be considered as precursors of the alkali metal salts of oxalic acid or alkali metal oxalates. Typical compounds include those that are insoluble in the aromatic ethers, for example, alkali metal carbonates, those that are partially soluble in the aromatic ethers, for example, alkali metal phenates, and those that are soluble in the aromatic ethers, for example, alkali metal phenoxyphenates and alkali metal phenoxyphenoxyphenates. Among such alkali metal compounds, the potassium salts are generally preferred in that they are readily available and readily provide the desired colloidal dispersion.

The fluid compositions prepared in accordance with the process of the instant invention can be prepared by mixing the aromatic ether basestock with at least one alkali metal precursor compound to form a mixture in the form of a slurry, slurry/solution, or solution, depending upon the solubility of the alkali metal precursor compound in the aromatic ether basestock.

It will be apparent that the concentration of the alkali metal precursor compound in the aromatic ether basestock is not narrowly critical and can vary within fairly wide limits. Indeed, all that is necessary is that the concentration is sufficient to provide the desired colloidal dispersion of the aromatic ether and an oxidative inhibiting amount of the alkali metal salt of oxalic acid as hereinafter discussed. Convenient, albeit nonlimiting, concentrations range from about 1 mmol to about 20 mmols, preferably from about 5 mmols to about 15 mmols, and most preferably from about 8 mmols to about 12 mmols of the alkali metal precursor compound per kilogram (kg) of aromatic ether.

Following the formation of the aromatic ether/alkali metal precursor compound mixture, the resultant mixture is subjected to conditions effective to convert the mixture into a colloidal dispersion comprising an oxidation inhibiting amount of the alkali metal salt of oxalic acid in the aromatic ether. Noncolloidally dispersed solid material, if present, is separated or removed from the colloidal dispersion by a variety of conventional separation techniques well known to those skilled in the art, including filtration, centrifugation and decantation of the supernatant colloidal dispersion from the noncolloidally dispersed solid material. In a preferred embodiment, the noncolloidally dispersed material is separated from the colloidal dispersion by filtration through a filter having a pore size effective to retain such noncolloidally dispersed solid material and permit the colloidally dispersed particles to pass therethrough to thereby recover the oxidation inhibited fluid composition.

It will be apparent that the conditions effective to convert the aromatic ether/alkali metal precursor mixture to the desired colloidal dispersion will depend to some extent upon the particular aromatic ether employed as the basestock and the source material for the alkali metal salt of oxalic acid. In general, the mixture is heated at a temperature of from about 225° C. to about 300° C., preferably about 280° C., in the presence of molecular oxygen or a molecular oxygen-containing gas, preferably air, for a period of from about 3 hours to about 48 hours, preferably from about 12 hours to about 36 hours, and most preferably from about 20 hours to about 24 hours. At these conditions (which may be conveniently referred to as "alkali metal precursor compound conversion conditions"), the alkali metal precursor compound employed as the source material for the alkali metal salt of oxalic acid undergoes an in situ oxidation and is converted into the corresponding alkali metal salt of oxalic acid. The resultant alkali metal salt of oxalic acid is dispersed as colloidal sized particles to form the desired colloidal dispersion of alkali metal salt of oxalic acid in the aromatic ether.

The concentration of the alkali metal salt of oxalic acid in the aromatic ether is not narrowly critical and will depend to some extent upon the particular aromatic ether and alkali metal salt of oxalic acid employed as components of the fluid composition and the ultimate end use for the fluid composition. All that is necessary is that the alkali metal salt of oxalic acid be-.present as a colloidal dispersion at a concentration effective to inhibit oxidative degradation of the aromatic ether. At the same time, however, the concentration of the colloidally dispersed alkali metal salt of oxalic acid must not exceed, or preferably must be less than, the agglomeration/precipitation threshold for such alkali metal salt of oxalic acid in the aromatic ether. In general, concentrations of from about 0.20 mmol to about 2.50 mmols, preferably from about 0.30 mmol to about 2.00 mmols, of colloidally dispersed alkali metal oxalate per kg of fluid composition are sufficient to impart the desired inhibition of oxidative degradation to the aromatic ether. However, in the event the concentration of the colloidally dispersed alkali metal salt of oxalic acid is greater than the agglomeration/precipitation threshold value for such alkali metal salt of oxalic acid in the aromatic ether, in particular greater than the generally desirable 2.50 mmols/kg upper limit or greater than any other specified desirable value, fresh aromatic ether may be added to the fluid composition to dilute the fluid composition to a desirable concentration of choice.

It will be apparent to those skilled in the art that the fresh aromatic ether employed as a diluent may be the same as, or different from, the aromatic ether basestock employed initially to prepare the colloidal dispersion. A different aromatic ether, including blends of two or more aromatic ethers, may be used advantageously as a diluent to achieve certain desirable properties—for example, a lower solidification point for the aromatic ether basestock and ultimately the fluid composition.

The following specific examples illustrating the best currently-known method of practicing this invention are described in detail in order to facilitate a clear understanding of the invention. It should be understood, however, that the detailed expositions of the application of the invention, while indicating preferred embodiments, are given by way of illustration only and are not to be construed as limiting the invention since various changes and modifications within the spirit of the invention will become apparent to those skilled in the art from this detailed description.

EXAMPLES 1–6

General (a) Oxidative Stability

The oxidative stability of the fluid compositions prepared in accordance with the process of this invention, as well as that of the aromatic ether basestock, was determined using a modified Corrosion & Oxidation (C&O) test as specified in the military specification MIL-L-87100 in accordance with Method 5307 of FED-STD 791. In accordance with this test, the fluid composition (lubricant) to be tested was heated over a 48-hour period at a specific temperature [343° C. (650° F.), as opposed to the stated standard temperature of 320° C. (608° F.] at a dry air flow rate through the fluid composition of 10 L/hr in the presence of certain metal specimen specified as aluminum (bottom), silver, mild steel, M-50 steel, Waspaloy (a nickel-based alloy), and titanium (top) and the viscosity increase of the fluid composition was determined. In addition, information as to the corrosivity of a fluid composition to metals may be determined, if desired.

Viscosity measurements were made according to ASTM Method D445-88 using a Cannon-Fenske modified Ostwald viscosimeter. The percentage of viscosity increase was determined by taking the difference in viscosity of a fluid composition before and after it was heated, dividing that difference by the original viscosity and multiplying the quotient by 100.

(b) Storage Stability

The storage stability of the fluid compositions prepared in accordance with the process of this invention, as well as that of the aromatic ether basestock, was determined using Method 3403 of FED-STD 791, except that the method was modified to serve as an accelerated storage stability test. In accordance with this modified test, a sample of the fluid composition (neat) to be tested was stored in a loosely capped glass container (usually a small flask) in an oven maintained at 120°–125° C. (248°–257° F.) for a period of 168 hours or more, up to several months. At the end of the storage period, the sample, without a final centrifugation step, was visually inspected for turbidity with white light shining through the sample at a 180° angle to the line of sight. Noticeable turbidity at any time during the test period resulted in the fluid composition being characterized as having failed the test.

(c) Solid Material Component Identification

The colloidally dispersed solid material component of the fluid compositions was isolated from the fluid composition by mixing the fluid composition with diethyl ether and extracting the fluid composition/diethyl ether mixture with water, followed by evaporation of the aqueous extract to yield a solid material. The resultant solid material was identified as the corresponding alkali metal salt of oxalic acid (for example, potassium oxalate for potassium precursor compounds), using standard procedures, by infrared spectra, titration with hydrochloric acid, titration with permanganate, and ICAP analysis.

EXAMPLE 1 (Comparative)

This Example illustrates a typical prior art process using soluble potassium salts to stabilize polyphenyl ethers. The fluid composition was prepared according to the procedure described in Example 38 of U.S. Pat. No. 3,492,229.

A polyphenyl ether basestock having a composition, by weight, of:

64% m-bis(m-phenoxyphenoxy)benzene

32% m-[(m-phenoxyphenoxy)(p-phenoxyphenoxy)]-benzene

4% m-bis(p-phenoxyphenoxy)benzene was employed. Potassium m-(m-phenoxyphenoxy)phenate was dissolved in the basestock at two concentration levels—7.40 mmols/kg and 3.12 mmols/kg. These fluid compositions were further diluted with additional polyphenyl ether basestock to provide samples at concentrations of 1.58 mmols/kg and 0.79 mmol/kg. The oxidative stability and the storage stability of the fluid compositions were determined as described for the Oxidative Stability test and the Accelerated Storage Stability test, respectively. The results were as follows:

| | Conc.[1] | C & O Results (Viscosity, $m^2/s$)[2] | | | Acc. Storage Stability | |
|---|---|---|---|---|---|---|
| Sample | mmols/kg | Initial[3] | Final[3] | % Change | Appearance | Comment |
| 1 | 7.40 | 368.0 | 463.0 | +25.8 | Dark brown ppt.[4] | Failed |
| 2 | 3.12 | 364.0 | 434.0 | +19.3 | Dark brown ppt.[4] | Failed |
| 3 | 1.58 | ND[5] | ND[5] | ND[5] | Dark brown ppt.[4] | Failed |
| 4 | 0.79 | ND[5] | ND[5] | ND[5] | Transparent[4] | Passed |

[1]Potassium m-(m-phenoxyphenoxy)phenate in the fluid composition.
[2]At 38° C. (100° F.).
[3]Stated value × $0^{-6}$.
[4]After one (1) week.
[5]Not determined.

The results indicate that the fluid compositions containing soluble potassium salts exhibited excellent results in the C&O test at 343° C. (650° F.). However, except for Sample 4, the fluid compositions developed clumps of dark brown precipitate following one (1) week of storage, thereby failing the Accelerated Storage Stability test. The formation of the dark brown precipitate further indicates the likelihood that such fluid compositions could be prone to forming deleterious precipitates under use conditions, particularly, high stress conditions.

EXAMPLE 2

This Example illustrates the preparation of a colloidal dispersion of an alkali metal oxalate, potassium oxalate, in an aromatic ether basestock from an insoluble alkali metal salt, potassium carbonate.

Run 1

The polyphenyl ether basestock (405 g) employed in Example 1 was charged to a 500 mL round-bottomed flask fitted with a glass paddle stirrer, a fritted glass air bubbler, a thermometer, and a bent glass exit tube and heated while a stream of air [flowing through a tube packed with anhydrous calcium sulfate (Drierite)] was passed therethrough at the rate of 75 scc/min. When the temperature of the polyphenyl ether basestock had reached 130° C., 0.34 g (0.0025 mol) of potassium carbonate in the form of coarse granular powder {primarily larger than 50 mesh [300 microns (μm)]} was added, with rapid stirring to thoroughly mix and suspend the potassium carbonate in the polyphenyl ether basestock. Heating was continued to raise the temperature of the mixture to 280° C., while maintaining the passage of air therethrough. The mixture was maintained at these conditions for 23 hours, after which the air flow was turned off. The mixture was allowed to cool to 120° C. and was filtered through a Buchner funnel using a glass fiber filter (GF/F filter from Whatman) having an effective pore size of 0.7 μm to remove noncolloidally dispersed solid-phase material. The resultant fluid composition of a colloidal dispersion of potassium oxalate in the polyphenyl ether basestock was shown to have a concentration of 1.17 mmols of potassium oxalate per kg of fluid composition by titrating three samples (6.1 g, 6.1 g, and 4.5 g) of the fluid composition with 0.01N hydrochloric acid in water-acetone solvent to the first end point [$KH(COO)_2$] using bromphenol blue indicator, followed by averaging the results obtained for the three samples. The fluid composition was diluted with fresh polyphenyl ether basestock to yield several lower concentrations.

The solid phase material collected in the Buchner funnel on the filter, as well as that remaining in the reaction flask, was washed several times with hot hexane to remove residual polyphenyl ether basestock and dried. The resultant dry solid phase material was identified as a mixture of potassium carbonate (75% by weight) and potassium oxalate (25% by weight).

Run 2

The procedure described in Run 1 was repeated to yield a fluid composition of a colloidal dispersion of potassium oxalate in the polyphenyl ether basestock at a concentration of 1.67 mmols/kg.

A C&O test from Runs 1 and 2 was carried out on the fluid compositions at various concentrations. An Accelerated Storage Stability test was carried out on the Run 2 fluid composition (Sample 6). In addition, a comparative C&O test was carried out on the neat polyphenyl ether basestock. The results were as follows:

| | Conc.[1] | C & O Results (Viscosity, $m^2/s$)[2] | | | Acc. Storage Stability | |
|---|---|---|---|---|---|---|
| Sample | mmols/kg | Initial[3] | Final[3] | % Change | Appearance | Comment |
| 1 | 0.00[4] | 12.45 | 237.6 | +1809.0 | ND[5] | |
| 2[6] | 0.070 | 12.72 | 104.7 | +723.0 | ND[5] | |
| 3[6] | 0.14 | 12.68 | 58.1 | +358.0 | ND[5] | |

-continued

| Sample | Conc.[1] mmols/kg | C & O Results (Viscosity, $m^2/s$)[2] Initial[3] | Final[3] | % Change | Acc. Storage Stability Appearance | Comment |
|---|---|---|---|---|---|---|
| 4[6] | 0.21 | 12.70 | 30.2 | +137.0 | ND[5] | |
| 5[6] | 0.35 | 12.70 | 13.33 | +5.0 | ND[5] | |
| 6[7] | 1.67 | 12.68 | 13.55 | +6.9 | Transparent[8] | Passed |

[1]Potassium oxalate [$K_2(COO)_2$] in the fluid composition.
[2]At 100° C. (212° F.).
[3]Stated value × $10^{-6}$.
[4]Neat polyphenyl ether basestock.
[5]Not determined.
[6]From Run 1 following dilution with fresh polyphenyl ether basestock.
[7]From Rum 2.
[8]After twenty-three (23) weeks.

The results demonstrate that at a threshold concentration of about 0.30 mmol/kg, a substantially constant level of oxidation inhibition is provided. However, at concentrations below this threshold level, the degree of oxidation inhibition, although observable, falls off quite rapidly.

EXAMPLE 3

This Example illustrates the preparation of a colloidal dispersion of an alkali metal oxalate, potassium oxalate, in an aromatic ether basestock from a soluble alkali metal salt, potassium m-(m-phenoxyphenoxy)phenate.

Run 1

The procedure described in Example 2, Run 1 was employed except that 1.03 g (0.0033 mol) of potassium m-(m-phenoxyphenoxy)phenate (which is soluble in the polyphenyl ether basestock) was substituted for the potassium carbonate and 273 g of polyphenyl ether basestock was employed to yield a solution of potassium phenoxyphenoxyphenate in the polyphenyl ether basestock of 12.00 mmols/kg. Following the heating with air at 280° C. for 23 hours and filtration, the resultant fluid composition of a colloidal dispersion of potassium oxalate in the polyphenyl ether basestock had a concentration of 4.67 mmols/kg.

Run 2

The procedure described in Run 1 was repeated except that 1.53 g (0.048 mol) of potassium m-(m-phenoxyphenoxy)phenate was dissolved in 404 g of polyphenyl ether basestock to yield a solution of potassium m-(m-phenoxyphenoxy)phenate in polyphenyl ether of 12 mmols/kg and the solution was heated for 21 hours at 280° C. in the presence of air. After filtration, the resultant fluid composition of a colloidal dispersion of potassium oxalate in the polyphenyl ether basestock had a concentration of 4.56 mmols/kg. The fluid composition was diluted with fresh polyphenyl ether basetock to a concentration of 0.70 mmol/kg.

A C&O test was carried out on the fluid compositions from Runs 1 and 2 and an Accelerated Storage Stability test were carried out on the fluid composition from Run 2. The results were as follows:

| Sample | Conc.[1] mmols/kg | C & O Results (Viscosity, $m^2/s$)[2] Initial[3] | Final[3] | % Change | Acc. Storage Stability Appearance | Comment |
|---|---|---|---|---|---|---|
| 1[4] | 0.70 | 12.74 | 13.91 | +9.18 | Transparent[5] | Passed |
| 2[6] | 4.67 | 12.73 | 14.11 | +10.80 | ND[7] | |

[1]Potassium oxalate [$K_2(COO)_2$] in the fluid composition.
[2]At 100° C. (212° F.).
[3]Stated value × $10^{-6}$.
[4]From Run 2 following dilution with fresh polyphenyl ether basestock.
[5]After fifteen (15) weeks.
[6]From Run 1.
[7]Not determined. However, at the end of the C & O test, a crystalline precipitate was present, thereby indicating that the concentration of potassium oxalate in the fluid composition was too high to remain stable as a colloidal dispersion.

EXAMPLE 4

This Example illustrates the preparation of a colloidal dispersion of an alkali metal oxalate, potassium oxalate, in an aromatic ether basestock from a partially soluble alkali metal salt, potassium phenate.

Run 1

The procedure described in Example 2, Run 1 was employed except that 1.27 g (0.0096 mol) of potassium phenate (which is slightly soluble in the polyphenyl ether basestock) was substituted for the potassium carbonate and mixed with 800 g of the polyphenyl ether basestock in a 1000 mL round-bottomed flask fitted as described in Example 1, Run 1 to yield a slurry/solution of potassium phenate in the polyphenyl ether basestock of 12.00 mmols/kg. Following the heating with air (150 scc/mino) at 280° C. for 45 hours and filtration (at 120° C.), the resultant fluid composition of a colloidal dispersion of potassium oxalate in the polyphenyl ether basestock had a concentration of 1.83 mmols/kg. The solid material collected on the filter consisted primarily of potassium oxalate, with traces of unidentified impurities (possibly potassium carbonate or potassium phenate).

Run 2

The procedure described in Run 1 was repeated except that 5.30 g (0.040 mol) of potassium phenate was mixed with 3346 g of polyphenyl ether basestock to yield a slurry/solution of potassium phenate in polyphenyl ether of 12 mmols/kg and the slurry/solution was heated for 23 hours at 280° C. in the presence of air. After filtration, the resultant fluid composition of a colloidal dispersion of potassium oxalate in the polyphenyl ether basestock had a concentration of 2.67 mmols/kg. The fluid composition was diluted with fresh polyphenyl ether basestock to provide a concentration of 0.70 mmol/kg. A C&O test and an Accelerated Storage Stability test were carried out on the diluted fluid composition. The results were as follows:

| | Conc.[1] | C & O Results (Viscosity, $m^2/s$)[2] | | | Acc. Storage Stability | |
|---|---|---|---|---|---|---|
| Sample | mmols/kg | Initial[3] | Final[3] | % Change | Appearance | Comment |
| 1 | 0.70 | 12.48 | 13.56 | +8.70 | Transparent[4] | Passed |

[1]Potassium oxalate $[K_2COO)_2]$ in the fluid composition.
[2]At 100° C. (212° F.).
[3]Stated value × $10^{-6}$.
[4]After forty-two (42) weeks.

EXAMPLE 5

This Example illustrates the preparation of a colloidal dispersion of an alkali metal oxalate, sodium oxalate, in an aromatic ether basestock from a soluble alkali metal salt, sodium m-phenoxyphenate.

The procedure described in Example 2, Run 1 was employed, except that 0.38 g (0.0018 mol) of sodium m-phenoxyphenate (which is soluble in the polyphenyl ether basestock) was substituted for the potassium carbonate and dissolved in 302 g of the polyphenyl ether basestock to yield a solution of sodium m-phenoxyphenate in the polyphenyl ether basestock of 6.00 mmols/kg. Following the heating with air at 280° C. for 16 hours and filtration, the resultant fluid composition of a colloidal suspension of sodium oxalate in the polyphenyl ether basestock had a concentration of 0.90 mmol/kg.

The fluid composition was diluted with fresh polyphenyl ether basestock to provide a concentration of 0.70 mmol/kg. A C&O test and an Accelerated Storage Stability test were carried out on the diluted fluid composition. The results were as follows:

| | Conc.[1] | C & O Results (Viscosity, $m^2/s$)[2] | | | Acc. Storage Stability | |
|---|---|---|---|---|---|---|
| Sample | mmols/kg | Initial[3] | Final[3] | % Change | Appearance | Comment |
| 1 | 0.70 | 12.51 | 39.60 | +137.00 | Transparent[4] | Passed |

[1]Sodium oxalate $[Na_2(COO)_2]$ in the fluid composition.
[2]At 100° C. (212° F.).
[3]Stated value × $10^{-6}$.
[4]After nine (9) weeks.

EXAMPLE 6

This Example illustrates the preparation of a colloidal dispersion of alkali metal oxalate, potassium oxalate, in an aromatic ether basestock from a soluble alkali metal salt, potassium m-(m-phenoxyphenoxyphenate.

The procedure described in Example 3 was employed, except that a six-ring polyphenyl ether basestock, bis[m-(m-phenoxyphenoxy)phenyl] ether, was substituted for the five-ring polyphenyl ether basestock. Following the heating with air at 280° C. for 21 hours and filtration, the resultant fluid composition of a colloidal dispersion of potassium oxalate in the polyphenyl ether basestock had a concentration of 2.09 mmols/kg.

A portion of the fluid composition was diluted with fresh polyphenyl ether basestock to provide a second concentration of 1.40 mmols/kg. A C&O test and an Accelerated Storage Stability test were carried out on the fluid composition at the two concentrations. The results were as follows:

| | Conc.[1] | C & O Results (Viscosity, $m^2/s$)[2] | | | Acc. Storage Stability | |
|---|---|---|---|---|---|---|
| Sample | mmols/kg | Initial[3] | Final[3] | % Change | Appearance | Comment |
| 1 | 1.40 | 24.58 | 27.02 | +9.93 | Transparent[4] | Passed |
| 2 | 2.09 | 24.41 | 27.13 | +11.14 | Transparent[4] | Passed |

[1]Potassium oxalate $[K_2(COO)_2]$ in the fluid composition.
[2]At 100° C. (212° F.).
[3]Stated value $\times 10^{-6}$.
[4]After thirty-seven (37) days.

Thus, it is apparent that there has been provided, in accordance with the instant invention, a process that fully satisfies the objects and advantages set forth hereinabove. While the invention has been described with respect to various specific examples and embodiments thereof, it is understood that the invention is not limited thereto and many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. A process for the preparation of an oxidation inhibited fluid composition comprising:.

(a) mixing an aromatic ether represented by the formula $$R^1—O—[—R^2—O—]_n—R^3$$

wherein $R^1$, $R^2$, and $R^3$ independently are phenyl, biphenyl, and terphenyl and n is an integer of from zero (0) to 5, and an alkali metal precursor compound convertible under alkali metal precursor compound conversion conditions into an alkali metal salt of oxalic acid, which alkali metal precursor compound is selected from the group consisting of alkali metal phenates characterized by being partially soluble in the aromatic ether, and alkali metal m-phenoxyphenates, alkali metal m-(m-phenoxyphenoxy)phenate, and mixtures thereof characterized by being soluble in the aromatic ether, (b) heating the aromatic ether/alkali metal precursor compound mixture from Step (a) at an elevated temperature in the presence of molecular oxygen or a molecular oxygen-containing gas and for a time sufficient to convert the alkali metal precursor compound into an alkali metal salt of oxalic acid and form a colloidal dispersion of the aromatic ether and an oxidation inhibiting amount of the alkali metal salt of oxalic acid, and (c) separating any noncolloidally dispersed solid material from the colloidal dispersion of Step (b) to thereby recover the oxidation inhibited fluid composition, the fluid composition being characterized by being transparent when subjected to visual inspection with white light shining through the fluid composition at a 180° angle to the line of sight.

2. The process of claim 1 wherein the alkali metal phenate is selected from the group consisting of sodium phenate and potassium phenate.

3. The process of claim 2 wherein the alkali metal phenate is potassium phenate.

4. The process of claim 1 wherein the alkali metal precursor compound is soluble in the aromatic ether.

5. The process of claim 1 wherein the alkali metal m-phenoxyphenate is selected from the group consisting of sodium m-phenoxyphenate and potassium m-phenoxyphenate.

6. The process of claim 5 wherein the alkali metal m-phenoxyphenate is potassium m-phenoxyphenate.

7. The process of claim 1 wherein the alkali metal m-(m-phenoxyphenoxy)phenate is selected from the group consisting of sodium m-(m-phenoxyphenoxy)phenate and potassium m-(m-phenoxyphenoxy) phenate.

8. The process of claim 7 wherein the alkali metal m-(m-phenoxyphenoxyphenate is potassium m-(m-phenoxyphenoxy)phenate.

* * * * *